United States Patent [19]

Slaughterbeck

[11] 4,204,447

[45] May 27, 1980

[54] APPARATUS FOR PERFORATING CORRUGATED PLASTIC PIPE

[76] Inventor: David W. Slaughterbeck, Rte. #7, Findlay, Ohio 45840

[21] Appl. No.: 861,424

[22] Filed: Dec. 16, 1977

[51] Int. Cl.[2] ..... B26F 1/08; B26F 3/08

[52] U.S. Cl. ..... 83/171; 83/54; 83/337

[58] Field of Search ..... 83/171, 170, 15, 16, 83/54, 337

[56] References Cited

U.S. PATENT DOCUMENTS

| | | | |
|---|---|---|---|
| 2,753,001 | 7/1956 | Page | 83/337 X |
| 3,355,974 | 12/1967 | Carmichael | 83/171 OR |
| 3,483,777 | 12/1969 | Neugebauer | 83/171 X |
| 3,654,829 | 4/1972 | Anderson | 83/171 X |
| 3,683,736 | 8/1972 | Loose | 83/337 X |
| 3,707,102 | 12/1972 | Huppenthal et al. | 83/171 OR |
| 3,719,736 | 3/1973 | Woodruff | 83/16 X |
| 3,901,113 | 8/1975 | Oltmanns et al. | 83/54 X |

*Primary Examiner*—Frank T. Yost

*Attorney, Agent, or Firm*—Oliver E. Todd, Jr.

[57] ABSTRACT

An apparatus for perforating the minor diameter or inner corrugation of a transversely corrugated thermoplastic drainage pipe. A plurality of perforations are simultaneously formed in the inner corrugations of the pipe by reciprocally moving heated punches radially into the pipe, removing the punches and then translating the pipe to another position for the next punching step. In an alternative embodiment, the punches are carried by a rotating ring which positions them opposite an inner corrugation and a cam device drives the punch radially into the pipe.

13 Claims, 6 Drawing Figures

APPARATUS FOR PERFORATING CORRUGATED PLASTIC PIPE

BACKGROUND OF THE INVENTION

This invention relates to an apparatus and method for forming drainage holes in corrugated plastic drainage pipe. Many drainage pipes are produced from plastic materials, either by extrusion or blow molding, with the pipe being cut into finite lengths or carried as an endless pipe on a large drum or sizing in the field. To obtain high rigidity and maximum utilization of the material, such drainage pipes are commonly corrugated with the corrugations extending circumferentially around the pipe. Preferably, drainage holes are positioned in the wall of the inner corrugation so that, when the pipe is ultimately buried in the earth, the drainage holes are not packed as tightly as would be the case if they were positioned in the outer corrugation. This facilitates drainage from the pipe, but, for obvious reasons, complicates the method for forming the perforations.

It is also desirable that the perforations be relatively large in size and that they have no protruberance or obstructions to the flow of liquid in the pipe. For example, a hole formed by a drill or cold punch will leave a burr or other extending protruberance within the pipe which will snag and entrap small roots or other fibrous matter entrained in the liquid being carried. This will eventually cause a buildup of solids at that point, thereby closing the hole and ultimately reducing the effective diameter of the pipe itself.

One method of perforating such drainage pipes is disclosed in U.S. Pat. No. 2,697,264. This method limits itself to perforating only a short length of pipe, since it utilizes a mandril to support the pipe for punching. Other methods of perforation, such as shown in U.S. Pat. Nos. 2,834,983 and 3,892,514 disclose apparatuses for perforating the pipe simultaneously with the manufacture of the pipe itself. The obvious limitation in these methods is that they can make only perforated pipe, thereby requiring a separate machine to produce non-perforated pipes. Finally, recently issued U.S. Pat. No. 4,055,098 shows a pipe perforating apparatus which uses a cold punch and provides means for supporting the pipe in the punching area to prevent deformation thereof. While the aforementioned patents describe various methods and apparatuses for perforating pipe in the manner described which have been used commercially, each has certain limitations which limit their effective use, such as cost of installation, inability to provide clean perforations free of burrs or protruberances, etc.

SUMMARY OF THE INVENTION

The present invention relates to a punching apparatus utilizing a heated punch which requires no internal reinforcement of the pipe section being punched and which will provide a perforation of the desired size which is free of burrs or protruberances within the pipe. Furthermore, the present apparatus is capable of cleanly punching out a finite circular waste piece or plug which can be easily collected and recycled in the extruder forming the pipe. This has an advantage over other types of apparatuses which use a saw or similar device to form a slot because the saw leaves a very fine grain plastic dust which cannot be easily collected and furthermore is fine to the extent that it becomes entrained in the airstreams and pollutes the environment by either atmospheric or water pollution.

In accordance with the present invention, there is provided apparatus for perforating corrugated drainage pipe which has a plurality of punches which are heated to a point slightly below the melting temperature of the pipe to be punched. The apparatus includes a mechanism to advance and withdraw the punches from the pipe and includes a heater associated with the punches adapted to keep them at the proper temperature and an advancing means by which the corrugated pipe is advanced from a remote position to a punching position and thence to a second remote position downstream from the punching position.

Other objects and advantages of the invention will be apparent from the following detailed description of preferred embodiments thereof, with reference being made to the accompanying drawings.

DESCRIPTION OF THE PREFERRED EMBODIMENTS

Figure 1:
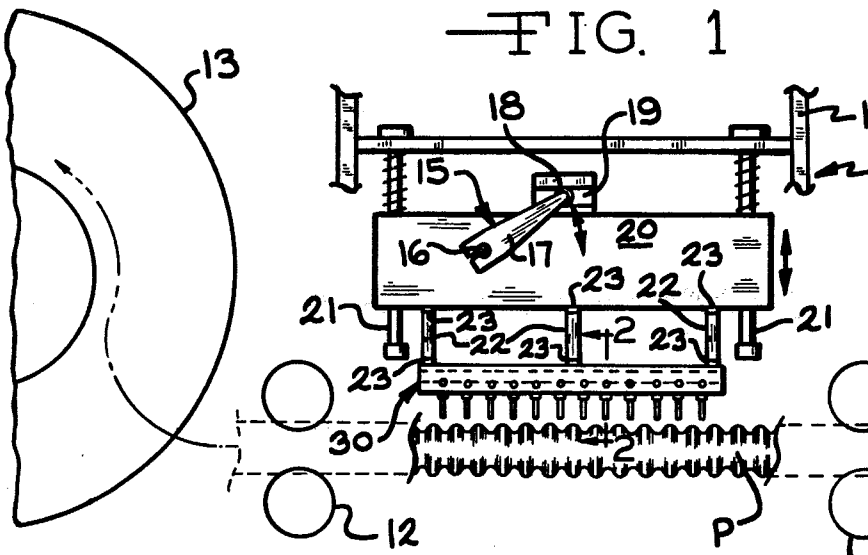
FIG. 1 is a simplified side elevation view of a punching apparatus according to the present invention showing schematically the extruding or blow molding apparatus and one side of the punching apparatus and a take-up reel for the pipe on the other side thereof.

Referring first to FIG. 1, the hot punching apparatus of this invention is shown generally as indicated by reference numeral 10. A pipe molding machine 11, which may be either of the extrusion or blow molding variety as disclosed in one or more of the aforesaid United States patents is schematically illustrated at reference numeral 11 and produces a relatively thin wall of thermoplastic corrugated pipe as shown. Pipe P is advanced from right to left in the drawing in steps, the length increment of which will be dependent upon the number of punches in the punching apparatus 10 as will be apparent to those skilled in the art. A given length of pipe is advanced to a punching position under the punch apparatus 10, held there for a predetermined time while the punching step is completed, and then advanced beyond the punching apparatus so that the next incremental section is brought into punching position. The completely perforated pipe is then wound up on a take-up device such as the spool 13 or, if preferred, can be cut in predetermined lengths and stacked for shipment to the field.

Figure 3:
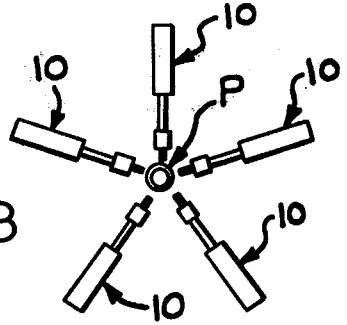
FIG. 3 is a schematic end view of a plurality of punches arranged around the periphery of a pipe.

The punching apparatus 10 includes a plurality of rows of punches positioned around the periphery of the pipe P, as shown in FIG. 3. FIG. 1 shows only a single series of ganged punches and the mechanism for reciprocating that group of punches; it will be understood that the device in question will include a plurality of gangs of punches positioned at equally spaced intervals around the periphery of the pipe P.

Referring again to FIG. 1, elements of the fixed machine frame 14 are shown which would encircle the pipe P and carry the reciprocating mechanism for each of the rows of punches, the mechanism being generally indicated by reference numeral 15. A driven rotary shaft 16 has attached thereto a radial arm 17 the outer end of which contains a slider 18 which moves within a slide 19 which is secured to the punch head 20. The driven shaft 16 is turned by a suitable mechanism (not shown) in alternate rotary movements as indicated by the arrow so that the reciprocating head 20 is caused to reciprocate up and down along guide pins 21 extending therethrough and secured to the machine frame 14. As will be apparent to those skilled in the art, the guide pins 21 keep the head 20 in alignment with the pipe P so that its movement is on a radial path, as will be apparent from FIG. 3. A punch head 30 is connected to the reciprocating head 20 by a plurality of support rods 22. These rods thermally isolate the punch head 30 from the reciprocating head 20 and one or more insulator discs 23 can be used on each end of the rods 22 to further thermally insulate the heated punch head 30 from the mechanism thus far described.

Figure 2:
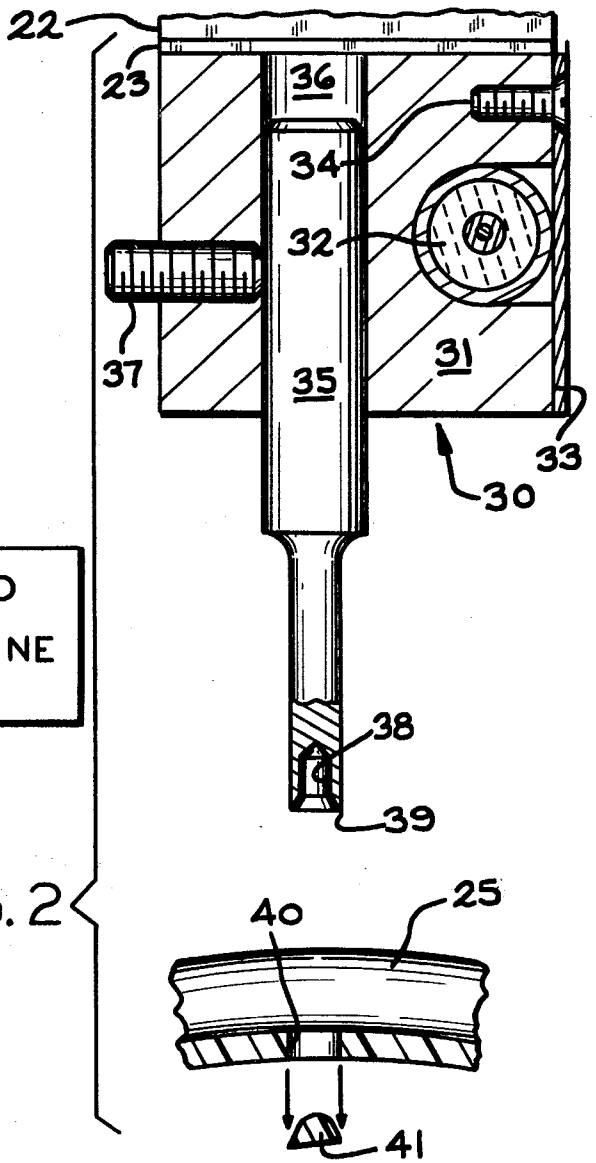
FIG. 2 is an enlarged sectional view of the punching apparatus of this invention, taken along line 2—2 of FIG. 1 and illustrating the manner in which individual punches are held in a holder along with a heating means.

Referring now to FIG. 2, a cross-section of the punch head 30 is shown. It includes an elongate punch retainer 31 having a machined passage in one side thereof which receives an elongate standard heating element 32, such as a Cal-rod type heating unit or other electrical resistance element. The heating unit 32 is in good thermal contact with the retainer 31 as shown so that its heat is distributed throughout the retainer element 31 which will be of a strong heat conductive material, such as steel. The heating element 32 is secured in the retainer 31 by an external plate 33 removably attached by a common threaded fastener such as the screw 34. Each of the punches 35 is retained in a vertical bore 36 extending into the retainer 31 and held there by a set screw 37 or other similar device. The bore 36 is of a size to snugly receive the exterior of the punch body 35 so that good thermal contact is also maintained.

The punch 35 itself is preferably shaped as shown with the diameter of the lower end of a size to punch the desired hole in the corrugated pipe P. It has been discovered that the lower punching end is preferably provided with a cavity 38 which flares outwardly in a frustoconical shape to provide an annular cutting edge 39. It has been discovered that punches in which the lower end has a straight or non-tapered shank are desirable in that no buildup of melted or partially molten material is left upon the shank as they are withdrawn from the punched wall pipe and that this straight configuration provides a strong punch which will not bend or fracture. In addition, through use of the counterbored recess 38 in its frustoconical edge a reclaimable slug or pellet is formed which is of the size sufficient to be easily gathered and reclaimed and is free from fine dust which would tend to pollute the atmosphere. In a preferred punch size, the outer diameter of the lower end of the punch is 3/16 inches while the counter bore is ⅛ inch in diameter, which dimensions have been found to provide a punch of satisfactory strength and heat conducting ability for use with polyethylene drain pipe which has a wall thickness of about 0.025 inches.

As previously stated, the punches are heated by the heater element 32 to a temperature substantially the same but preferably slightly less than the melting temperature of the thermoplastic material from which the pipe is fabricated. For example, certain grades of polyethylene have a melting temperature of about 325 degrees Fahrenheit. By adjusting a control element to maintain the punches at a temperature of 325° F. or slightly less, such as 300° F., the punch can be used to pierce the aperture of the wall without deforming it, as would be the case of a cold operation, and yet without excessively melting it which would cause an elongate or enlarged hole and also may cause a melted protruberance to extend within the inside of the pipe. It is believed that this is accomplished by the apparatus of this invention which applies the heated punch under pressure to the outside of the wall, causing the punch to initially melt away a portion of the area being punched to weaken that area under pressure; then, further movement of the punch in effect breaks away the remaining unmelted portion of the hole area so that the hole is in effect both melted and physically punched in one operation. It has been found that this combination of operations can be attained by careful adjustment of the heat of the punches, as stated above, with the use of normal punching speeds and pressures and that an operator can easily adjust the heat upwardly and downwardly in a given operation to attain this desired result.

Referring again to FIG. 1, the unperforated pipe P advancing out of the mold machine 11 is moved to the punching position beneath the punching apparatus 10. Once an unperforated segment has reached this position and is temporarily held there, the rotary reciprocating motion of the shaft 16 is transformed into the vertical movement of the head 20 and thus the punch holder 30 and its punches 35. The heated punches 35, each one having its axis coincident with radial reference axes of the pipe P, is moved radially inward towards the pipe P to the point where each of the punched tips makes contact with the outer surface of the inner corrugation of the pipe, partially melts and then punches through the wall of the pipe and is then rapidly withdrawn to the retracted position. As the punches 35 are withdrawn outside of the pipe wall, the pellets or plugs 41 make slight frictional engagement with the wall of the pipe and are knocked inwardly to remain in the interior of the pipe, thus keeping the punches free from plastic buildup. Because of the straight shank used on the punches, any flare or lip caused to be formed on the interior of the pipe by the inward motion of the punches is drawn outwardly and removed from the inside of the pipe, thus eliminating this undesirable by-product of most punching operations. When all of the punches have reached their retracted position, the drive mechanism 12 then advances the punched segment of the pipe towards the take-up reel 13 and another unpunched section moves into punching position. FIG. 2 at the bottom schematically shows a portion of the wall of the pipe P having an aperture or hole 40 formed therein with the knockout slug or pellet 41 dropping into the interior of the pipe.

Figure 5:
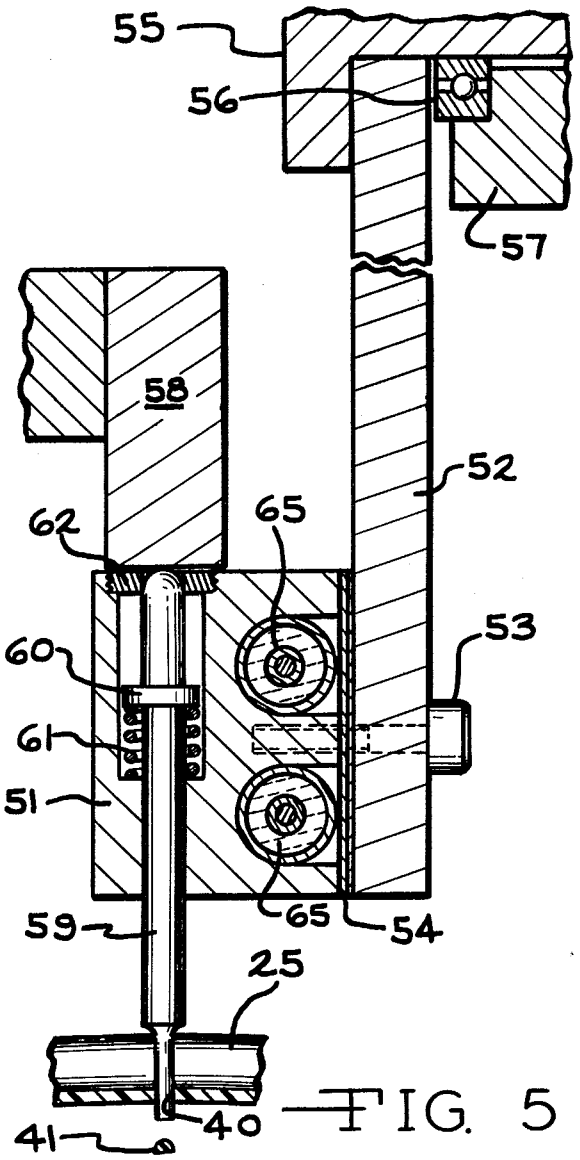
FIG. 5 is an enlarged sectional view taken along lines 5—5 of FIG. 4 showing the manner in which the punch is held and the punch is held in the punch holder in this embodiment.
Figure 4:
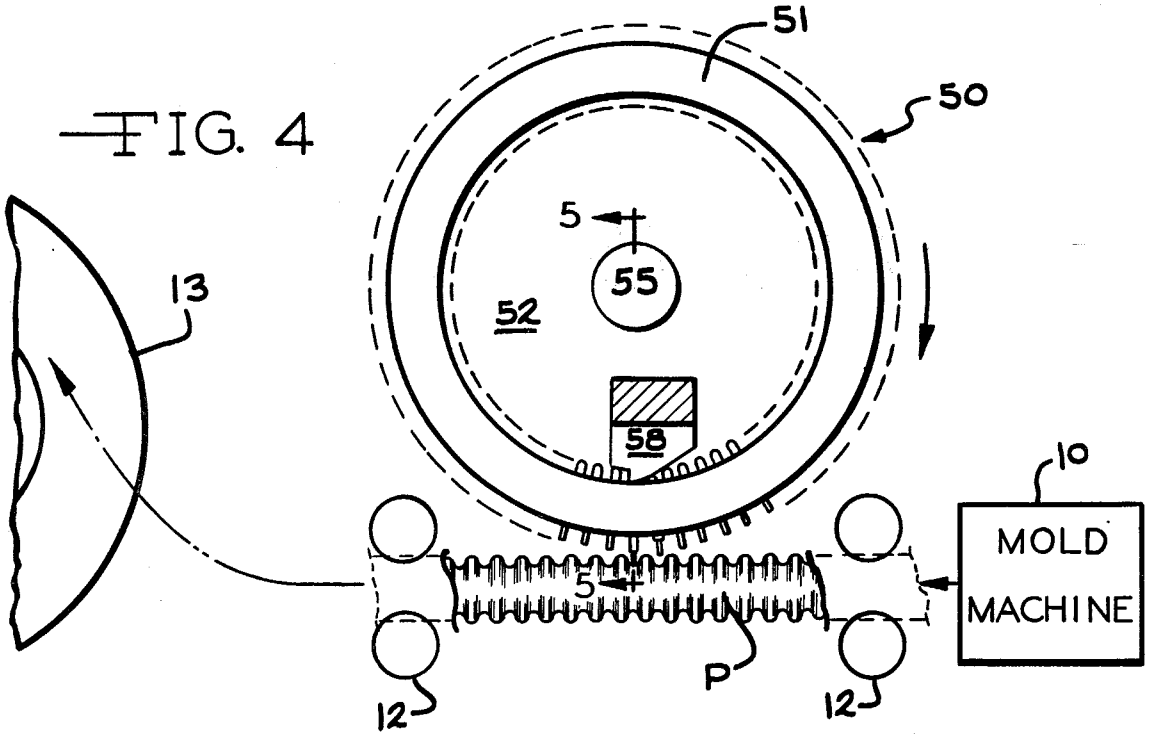
FIG. 4 is a side elevational view similar to FIG. 1 but showing another embodiment of the punching apparatus of this invention.
Figure 6:
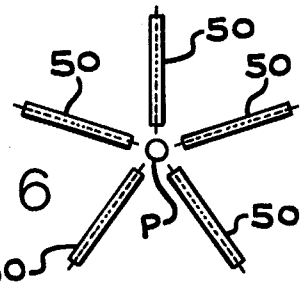
FIG. 6 is an end view similar to FIG. 3 but showing the embodiment of FIG. 4.

The different embodiment of the apparatus of this invention is schematically shown in FIGS. 4–6. This embodiment is particularly adapted for use with a pipe molding machine of the type where the movement of the molded pipe is continuous and does not alternately stop and go as is the case with the previous embodiment. In this embodiment of the punching apparatus, the molding machine 10 and take-up spool 13 are positioned on either side of the punching apparatus 50 in which a plurality of punches are held in an annular punch holder 51 which is secured to an internal support ring 52 which is journaled for rotation about a fixed axis 55. As is the case with previous embodiment, the apparatus includes a plurality of such punching mechanisms positioned in equally spaced segments about the periphery of the pipe P, as shown in FIG. 6, with only one such apparatus being illustrated in FIGS. 4 and 5. Referring now to FIG. 5, the annular punch holder 51 is secured to the outer edge of the support ring 52 by means such as threaded fasteners 53 which extend through the ring 52 and are threaded into the annular punch holder 51. The punch holder 51 is thermally insulated from the ring 52 by insulating discs or wedges 54 as shown so that the heat generated by heater elements is retained on the annular ring 52 and its punches. The support ring 52 is journaled for rotation on the fixed axis 55 by a bearing 56 between a fixed frame member 57. A power means for driving or rotating the ring 52 such that the peripheral speed of the punches mounted thereon coincides to the linear speed pipe P being punched is provided.

An axially free floating punch 59 having an end flange 60 is positioned within a recess bore in the punch holder 51 with a return spring compressed between the flange 60 and the seat of the bore as shown. A retainer 62 is screwed into the top end of the bore to retain the punch in position when the spring 61 is fully extended. As will be apparent from FIG. 4, the entire periphery of the punch holder 51 is provided with bores and reciprocating punches. A circular heating element 65 is positioned within a groove on the interface of the punch holder 51 in a similar manner to that of the previous embodiment of FIGS. 1–3 with suitable electrical connections being made to supply power to this element. As shown in FIG. 5, a pair of elements is provided to assure uniform heating of the members. This embodiment may require additional heat input since the reciprocating punch 59 is not in as good thermal contact with the retainer 51 as is the case of the previously described embodiment.

Referring to FIG. 4, a cam-type acuator 58 is positioned adjacent the inner-periphery of the annular punch holder 51 so that, when the holder 51 rotates in a clockwise direction as seen in FIG. 4, each of the protruding ends of the punches 59 strike the cam-surface of the acuator 58 and are pushed downwardly against the action of the spring 61, so that the punch 59 is extended radially outwardly away from the holder 51. Each punch reaches its furthest extension at a position opposite an innercorrugation and is pushed through the wall of the pipe. As that punch continues to move by rotation of the holder 51, it passes the land on the acuator 58 and snaps into the recess to quickly retract from the pipe and assume its retracted position until again presented to the start of the sloping cam-face. As is the case in the previous embodiment, the axis of each punch in its punching position coincides with radial reference axes of the pipe P and the slope of the cam is such that the punch does not make contact with the pipe until it is positioned opposite an intercorrugation, does not extend to pierce the wall of the pipe P until it is directly below the lower most portion of the cam, and quickly retracts from that extended position to leave the slug or pellet 41 within the pipe.

To reduce the mechanical wear on the punches 59 and the associated parts holding them into position, the length of the end of the punch from the ring 60 to the rounded top is such that the rounded top of the punch will strike the notched cam-surface to absorb the energy from the expanding spring 61; further movement away from the notched surface will gradually ease the punch into its fully retracted position until the ring 60 bears against the inner surface of the retainer means 62. Otherwise, the continuous hammering of the punch against the retainer ring 62 would cause unwanted mechanical vibration and wear on these members.

It will be seen from the above described two embodiments that the device of this invention can be used with a pipe molding and corrugating machine which is either continuous in movement or which reciprocates in incremental lengths. Through the use of a heated punch having a temperature substantially equal to or slightly less than the melting point of the thermal plastic material, the resulting holes are both melted and punched through the wall of the pipe, which has the effect of eliminating the unwanted effects of cold punching and also the unwanted effects of pure melting.

Furthermore, the apparatus of this invention provides a pellet or slug which is of large enough size to be easily recovered by conventional means and will not cause environmental pollution with the fine dust or waste as would be the case with a sawing or filing type of operation.

Other advantages of the instant invention will be apparent to those skilled in the art and various modifications may be made without departing from the scope of the appended claims.

I claim:

1. An apparatus for perforating the wall of an elongated tubular drain pipe of thermoplastic material having a predetermined melting temperature, said apparatus comprising, in combination, a plurality of spaced apart elongated punches having punching ends, means mounting each of said punches to reciprocate along an axis between a retracted position and an extended position, means for heating said punching ends to a temperature substantially equal to but slightly below the predetermined melting temperature of such thermoplastic material, means for axially moving said drain pipe from a remote position to a punching position opposite the punching ends of said punches, and means for reciprocally moving said punches from said retracted position to said extended position, said reciprocal movement being along the axis of each of said punches with that axis being coincident with radial reference axes extending substantially perpendicular to the axis of said drain pipe when said pipe is in said punching position, whereby said reciprocal movement of said punches causes said heated punch to slightly soften and then punch through the wall of said drain pipe when moved from said retracted position to said extended position.

2. The apparatus of claim 1 wherein said means for reciprocally moving said punches from said retracted to said extended position includes an annular punch retainer rotatably mounted along side the path of said drain pipe and securing a plurality of said punches for reciprocal motion along radii of said annular punch retainer such that their axes coincide with radial reference axes of said drain pipe when in said punching position, and means for reciprocally moving said punches toward and away from said drain pipe to thus move said punches between their retracted and punching positions.

3. The apparatus of claim 2 wherein said heating means is disposed within said annular punch retainer.

4. The apparatus of claim 3 wherein said heater means is a standard electrical resistance type heater.

5. The apparatus of claim 2 wherein there is a plurality of these apparatuses circumjacently disposed about the periphery of said pipe.

6. The apparatus of claim 2 wherein said means for reciprocally moving said punches from said retracted position to said extended position includes a stationary actuator having a camming surface disposed adjacent said punches whereby engagement and relative motion of the ends of said punches opposite said drain pipe against said camming surface move said punches from said retracted position to said extended position.

7. The apparatus of claim 2 wherein said means for reciprocally moving said punches toward and away from said drain pipe includes a stationary actuator means disposed within said annular punch retainer for advancing said punches radially outwardly.

8. The apparatus of claim 1 wherein said heating means heat said punches to a temperature of from 300° F. to 325° F.

9. The apparatus of claim 1 wherein said means for reciprocally moving said punches from said retracted to said extended position includes a rigid punch retainer mounted along side the path of said drain pipe and securing a plurality of such punches in spaced apart parallel relationship with their axes coincident with the radial reference axes of said drain tile when in said punching position, and means for reciprocally moving said rigid punch holder toward and away from said drain pipe to thus move said punches between their extended and retracted positions.

10. The apparatus of claim 9 wherein said heater means is disposed in said punch retainer.

11. The apparatus of claim 10 wherein said heater means is an electrical resistance type heater unit.

12. The apparatus of claim 9 wherein said punches are removably retained in apertures contained within said rigid punch retainer.

13. The apparatus of claim 9 which includes a plurality of these apparatuses circumjacently disposed about the periphery of said pipe.

* * * * *